United States Patent [19]

Caudill

[11] 4,149,705

[45] Apr. 17, 1979

[54] FOUNDRY LADLE AND METHOD OF MAKING THE SAME

[75] Inventor: Maurice L. Caudill, Peoria, Ill.

[73] Assignee: Caterpillar Tractor Co., Peoria, Ill.

[21] Appl. No.: 804,670

[22] Filed: Jun. 8, 1977

[51] Int. Cl.[2] ..... F27D 1/10

[52] U.S. Cl. ..... 266/281; 266/275; 264/30

[58] Field of Search ..... 13/35; 75/95; 110/1 A; 264/30; 222/590–607; 266/275–277, 280–281, 284–286; 432/264

[56] References Cited

U.S. PATENT DOCUMENTS

| | | | |
|---|---|---|---|
| 308,984 | 12/1884 | Pochin | 266/286 |
| 402,871 | 5/1889 | Truesdale | 266/281 |
| 711,026 | 10/1902 | Updike | 110/1 A |
| 3,345,059 | 10/1967 | Swindt | 264/30 |
| 3,400,859 | 9/1968 | Thakar et al. | 222/591 |

*Primary Examiner*—Gerald A. Dost

*Attorney, Agent, or Firm*—Wegner, Stellman, McCord, Wiles & Wood

[57] ABSTRACT

A foundry ladle including a ladle vessel having a cavity, a layer of crushable insulating material lining the cavity, the layer having perforations extending therethrough, and a layer of castable refractory material lining the insulating material, the refractory material extending through the perforations into load supporting contact with the vessel. Also disclosed is a method of forming a foundry ladle.

4 Claims, 2 Drawing Figures

FOUNDRY LADLE AND METHOD OF MAKING THE SAME

BACKGROUND OF THE INVENTION

This invention relates to foundry ladles and methods of lining the same.

The desirability of insulating foundry ladles of moderate size and larger has been long recognized. When well insulated, the melt contained within the ladle will remain in a molten state for a longer time, allowing use of the ladle and its contents for a longer period. In addition, less energy need be expended in heating the ladle to a desired pre-heat temperature or, alternately, a higher pre-heat temperature can be obtained with the same amount of energy. Lower tap temperatures are also attainable and a greater degree of safety is provided for those working in the vicinity of the ladle since the insulation impedes rapid heat transfer from the interior of the ladle to the exterior of the ladle.

Heretofore, insulated ladles have required the lining of the ladle with a layer of insulating brick under the working lining. The lining of the ladle with brick is a time-consuming, and thus expensive, endeavor.

SUMMARY OF THE INVENTION

The present invention is directed to overcoming one or more of the above problems.

According to the present invention, there is provided a foundry ladle including a ladle vessel having a cavity. A layer of crushable insulating material lines the cavity and the layer has perforations extending therethrough. A layer of castable refractory material lines the insulating material and extends through the perforations into load supporting contact with the ladle. The invention enables the use of non-brick insulating materials which are more easily installed.

The invention also contemplates a method of lining a foundry ladle including the steps of lining the cavity of a ladle vessel with a perforated, crushable insulating material and casting a layer of refractory material on the insulating material such that the refractory material extends through the perforations in the insulating material into load supporting contact with the vessel.

Other objects and advantages will become apparent from the following specification taken in connection with the accompanying drawings.

DESCRIPTION OF THE PREFERRED EMBODIMENT

Figure 1:
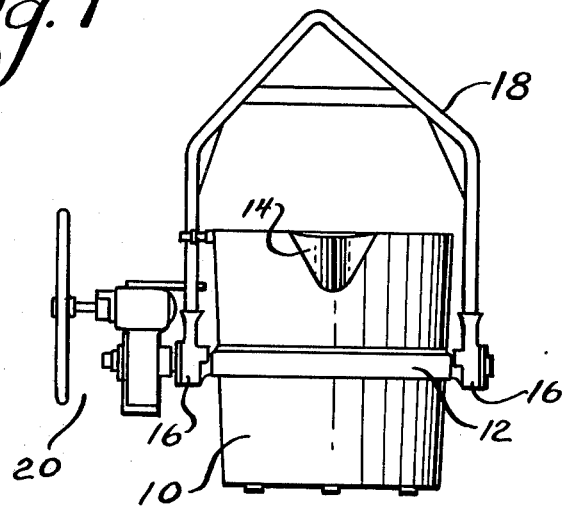
FIG. 1 is an elevational view of a ladle made according to the invention coupled with conventional support equipment therefor.

An exemplary embodiment of a ladle made according to the invention is illustrated in the drawings and with reference to FIG. 1, is seen to include an upwardly opening vessel 10, typically of metal or the like, received in a circular yoke 12 and having a pouring lip 14. The yoke 12 is pivoted in trunnions 16 at the lower end of a support yoke 18. Rotating equipment 20 of conventional construction is associated with the support yoke 18 and the trunnions 16 for rotating the yoke 12, and thus the vessel 10, to tip the same to allow molten metal contained in the vessel 10 to be deposited at a point of use.

Figure 2:
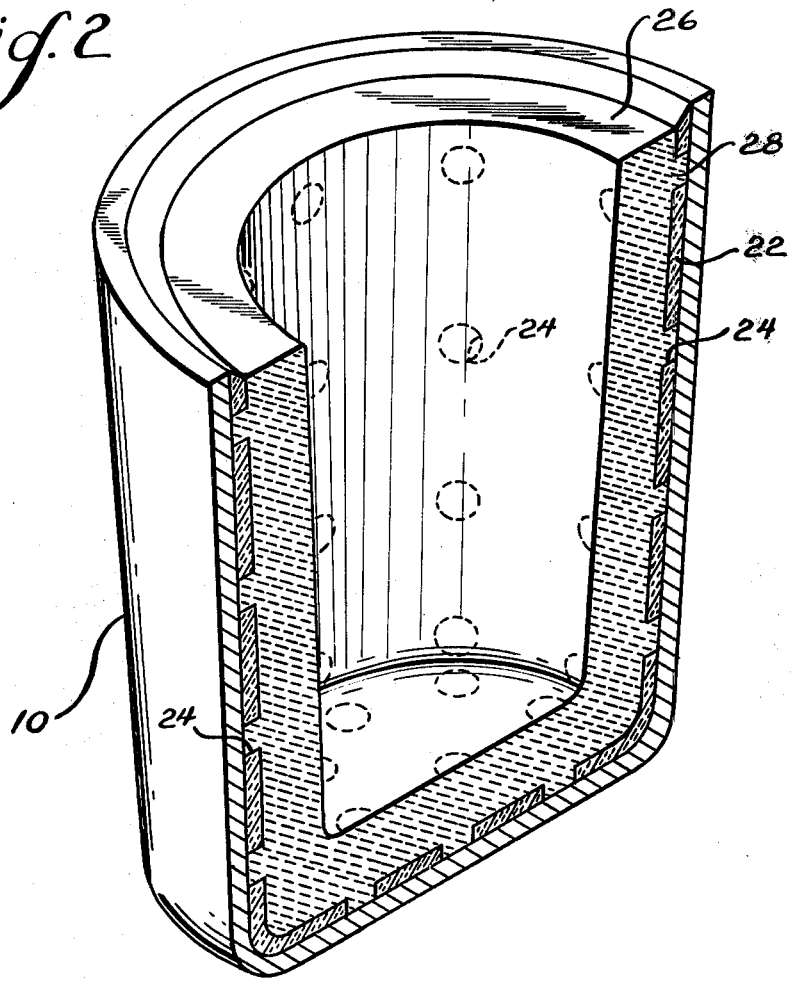
FIG. 2 is a perspective view of the ladle vessel with parts shown in section.

With reference to FIG. 2, the interior of the vessel 10 is lined with a layer of crushable insulating material 22. Preferably, the insulating material 22 is fibrous in nature and, in a highly preferred embodiment, includes alumina-silica ceramic fibers and is asbestos-free.

According to the invention, the lining 22 is placed on the interior of the vessel 10 in one or two layers and holes or perforations 24 are formed therein either prior to or after application of the layer 22. The holes 24 extend substantially completely through the layer 22 so as to expose the interior of the vessel. Thereafter, a refractory lining 26 is utilized to line the insulating layer 22.

The refractory liner 26 is of the castable type. As used herein, a "castable" refractory is one which may be cast in the conventional sense or which may be a "plastic" refractory which is rammed in place. Alternately, a castable refractory may be a sand material bonded with clay or sodium silicate or the like and the term is intended to encompass any of a variety of such materials which, upon compaction, solidification, or curing will retain their form.

The liner 26 is cast in place using conventional techniques in such a way that the refractory material extends through the holes 24 as at 28 into load supporting contact with the interior of the vessel 10. Alumina is a preferred material for the liner 26.

Heretofore, the use of fibrous or crushable insulating layers 22, which are easier to install than brick according to the prior art, has not been attainable due to the fact that when the lined vessel is filled with molten metal or the like, the weight of the same will cause the refractory lining 26, which is weak in tension, to crack, since the insulation is incapable of supporting the same. As a consequence, molten metal would flow through the cracks and the refractory lining 26 and into the insulating layer 22.

Through the present invention, the presence of the formations 28 which extend through the holes 24 into load supporting contact with the vesse 10 provides excellent support for the refractory lining 26 by precluding the generation of tensile stresses therein resulting from the lack of support by the insulating layer 22.

Although the invention has been described in connection with a so-called "lip pour" ladle, the same is applicable to "bottom tap" and other types of ladles as well.

As a consequence, an easily fabricated, long-lasting ladle construction is provided by the invention.

The embodiments of the invention in which an exclusive property or privilege is claimed are defined as follows:

1. A foundry ladle comprising:
   a ladle vessel having a cavity;
   a non-brick layer of crushable insulating material lining said cavity, said layer having perforations extending therethrough; and
   a layer of castable refractory material lining said insulating material, said refractory material having integral projections extending throughout and are flowed through said performations, said projections terminating against the interior of said vessel in load supporting contact therewith.
2. A foundry ladle comprising:
   a ladle vessel having a cavity;

a layer of crushable, non-brick fibrous insulating material lining said cavity, said layer having perforations extending therethrough; and a layer of castable refractory material cast in place to line said insulating material, said refractory material extending through said perforations into load supporting contact with said vessel.

3. A method of lining a foundry ladle comprising the steps of:

lining the cavity of a ladle vessel with a perforated, crushable, non-brick insulating material, and casting a layer of refractory material on the insulating material such that the refractory material flows through the perforations in the insulating material to define integral projections abutting and terminating at the vessel interior in load supporting contact therewith.

4. A method of lining a foundry ladle or the like comprising the steps of:

lining the cavity of a ladle vessel with a crushable non-brick fibrous insulating material, cutting holes through the insulating material to substantially expose parts of said vessel, and casting a refractory lining on said insulating material such that said refractory lining extends through said holes into load supporting contact with said vessel.

* * * * *